United States Patent [19]

Steinbach

[11] 4,191,036

[45] Mar. 4, 1980

[54] AXIAL SPLIT-PIN TUMBLER-TYPE LOCK MECHANISM AND KEY THEREFOR

[75] Inventor: Robert L. Steinbach, Chicago, Ill.

[73] Assignee: Chicago Lock Co., Chicago, Ill.

[21] Appl. No.: 869,851

[22] Filed: Jan. 16, 1978

[51] Int. Cl.[2] ..... E05B 27/08

[52] U.S. Cl. ..... 70/363; 70/404

[58] Field of Search ..... 70/363, 404, 403

[56] References Cited

U.S. PATENT DOCUMENTS

| | | | |
|---|---|---|---|
| 1,619,252 | 3/1927 | George | 70/363 |
| 3,916,657 | 11/1975 | Steinbach | 70/338 |
| 4,069,696 | 1/1978 | Steinbach | 70/363 |

*Primary Examiner*—Robert L. Wolfe.

*Attorney, Agent, or Firm*—Norman H. Gerlach

[57] ABSTRACT

An improvement is provided in a combination of an axial split-pin tumbler-type lock mechanism and a key therefor, wherein the mechanism includes a lock cylinder and an operating part rotatable therein, the operating part including a cylindrical head and a key guide post having a reduced diameter with respect to the head, the head having tumbler bores extending therethrough and disposed radially outwardly of the post, and wherein the key includes a shank having a socket adapted for receiving the post therein, and bittings on the outer periphery of the shank adapted for endwise engagement with tumblers carried by the bores to free the operating part for rotation, such improvement including means providing a longitudinal blind drive groove in the post and facing one of the tumbler bores substantially in a longitudinal plane therewith, and a drive lug on the shank extending radially inwardly from the wall of the socket and substantially in a longitudinal plane with one of the bittings and adjacent thereto, the lug being adapted to be received in the groove for interengaging the key and the operating part to cause the latter to rotate when the key is turned, the aforesaid one bitting being adapted to engage a tumbler carried by the aforesaid one bore. An additional improvement is the provision of a drive groove having a maximum depth of about 0.030 inch.

1 Claim, 8 Drawing Figures

AXIAL SPLIT-PIN TUMBLER-TYPE LOCK MECHANISM AND KEY THEREFOR

BACKGROUND OF THE INVENTION

This invention relates to an axial split-pin tumbler-type lock mechanism, more particularly, a tamper-resistant lock mechanism, and a key therefor.

Heretofore, various lock mechanisms of the axial split-pin tumbler type have been devised, having means designed to render them tamper- or pick-resistant. Generally speaking, it is possible ultimately to pick any key-operated lock mechanism, and efforts to prevent unauthorized picking are based on rendering the operation difficult and time-consuming, and, also, making it difficult to design a successful pick. Also, lock keys have been designed together with their lock mechanisms to render the keys difficult to duplicate, especially with conventional equipment, such as used by locksmiths, requiring, instead, specialized equipment.

A design which renders a lock mechanism more tamper-resistant at the same time is likely to make it more expensive, creating an economic disadvantage. In particular, non-standard parts may be required, which in turn may require specialized or altered manufacturing equipment, special manufacturing operations, and/or non-standard starting or unfinished manufacturing materials or parts, as a result of which the manufacturing cost is increased.

SUMMARY OF THE INVENTION

The present invention provides an axial split-pin tumbler-type lock mechanism and key therefor which provide increased tamper-resistance and render the key difficult to duplicate, thereby acting to forestall picking in several ways.

The lock mechanism of the invention uniquely accomplishes the objective of making it more difficult and/or expensive to design a suitable pick. Moreover, it would be difficult to operate a pick in the usual manner.

An important advantage is that the lock mechanism may be manufactured for relatively low cost, and, at the same time, it cooperates with a key which is difficult to duplicate without special machinery. The lock mechanism may be manufactured from starting materials and finished and unfinished parts employed in common with standard lock mechanisms of the type shown in U.S. Pat. No. 3,102,412, for example, with relatively small and inexpensive variations in the manufacture of the finished parts.

The improvements of the invention may be applied to standard lock mechanisms of the foregoing type, and, also, to more sophisticated lock mechanisms, such as that of U.S. Pat. No. 3,916,657 and others.

The invention provides a new and improved combination of a lock mechanism of the foregoing type and a key therefor, and an improved lock mechanism and an improved key employed in the combination. More specifically, the invention provides an improvement in a combination of an axial split-pin tumbler-type lock mechanism and a key therefor, wherein the lock mechanism includes a lock cylinder, and an operating part disposed forwardly within the cylinder and rotatable about a longitudinal axis extending between front and rear ends of the part, the operating part including a cyclindrical head and a key guide post having a reduced diameter with respect to the head and extending axially forwardly therefrom, the head having longitudinal tumbler bores extending therethrough and disposed radially outwardly of the post, and wherein the key includes a shank having a socket adapted for receiving the post therein, and bittings on the outer periphery of the shank adapted for endwise engagement with tumblers carried by the bores to free the operating part for rotation, such improvement comprising means providing a longitudinal blind drive groove in the post and facing one of the tumbler bores substantially in a longitudinal plane therewith, and a drive lug on the shank extending radially inwardly from the wall of the socket and substantially in a longitudinal plane with one of the bittings and adjacent thereto, the lug being adapted to be received in the groove for interengaging the key and the operating part to cause the latter to rotate when the key is turned, the aforesaid one bitting being adapted to engage a tumbler carried by the aforesaid one bore. An important additional improvement of the invention is the provision of a drive groove as aforesaid having a maximum depth of about 0.030 inch.

BRIEF DESCRIPTION OF THE DRAWINGS

The attached drawings illustrate a preferred embodiment of the lock mechanism and key combination of the invention, without limitation thereto. In the drawings, like elements are identified by like reference symbols in each of the views, and.

DESCRIPTION OF THE PREFERRED EMBODIMENT

Figure 1:
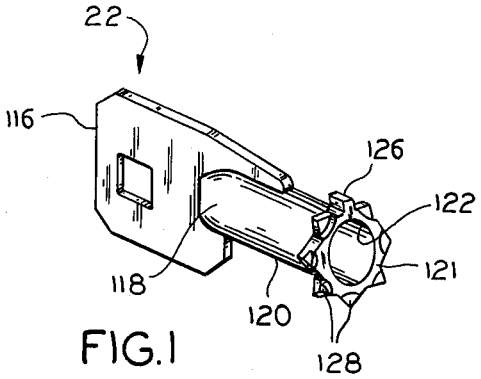
FIG. 1 is a perspective view of a key which cooperates with the lock mechanism of FIG. 4, in accordance with the invention.
Figure 4:
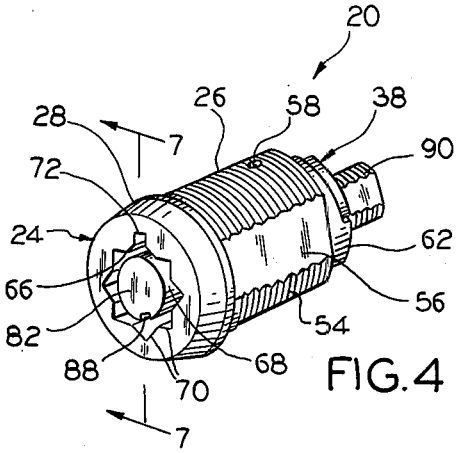
FIG. 4 is a perspective view of a lock mechanism according to the invention.

Referring to the drawings, particularly FIGS. 1–5, an axial split-pin tumbler-type lock mechanism or lock 20 is employed with a key 22 according to a preferred embodiment of the invention. The illustrative specific embodiment of the lock mechanism is identified as a "cam lock" mechanism but the invention is not limited thereto, and includes other specific lock types, such as the "switch lock" mechanism illustrated in U.S. Pat. No. 3,813,906. The key 22 is of a different type from the "flat" key of the latter patent, being of the "round" or "circular" type.

Figure 6:
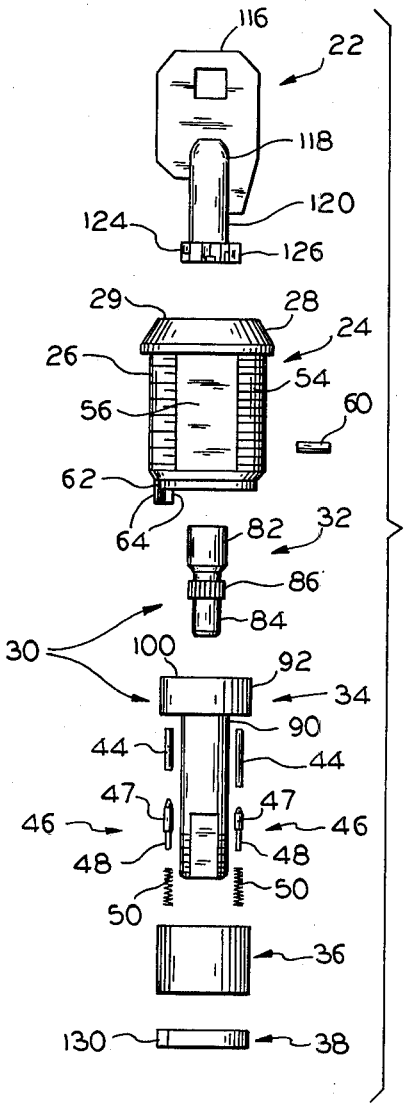
FIG. 6 is an exploded elevational view of the lock mechanism and key, drawn to a smaller scale, the lock being illustrated with but part of certain tumbler elements and springs shown.
Figure 7:
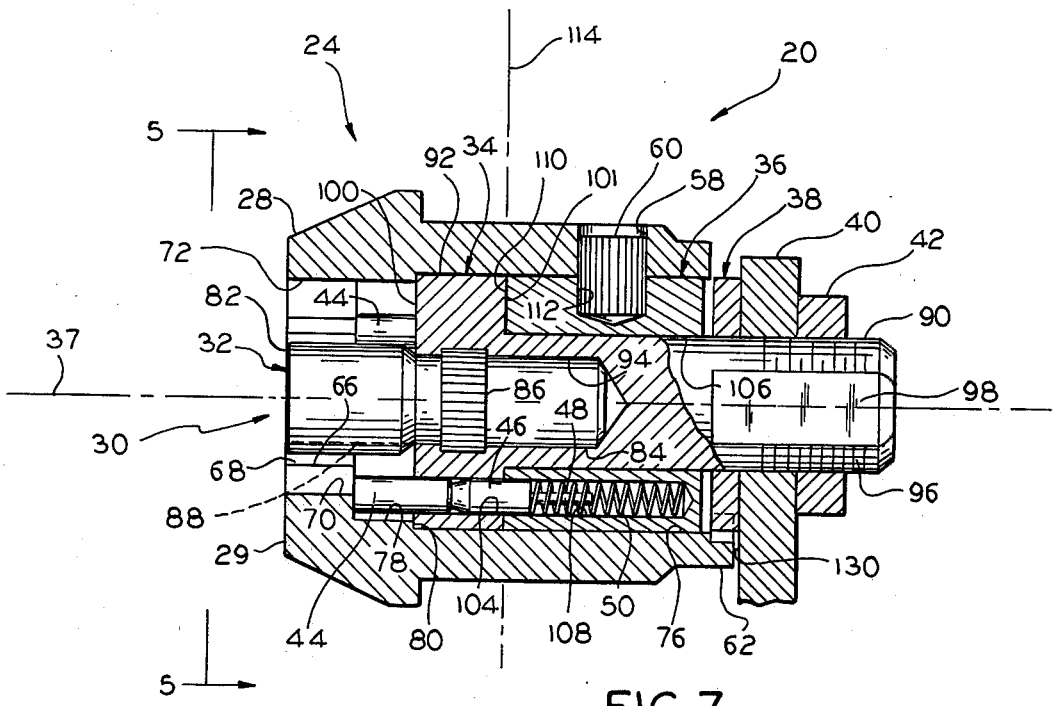
FIG. 7 is an enlarged longitudinal sectional and partly elevational and broken view of the lock mechanism, taken substantially on line 7—7 of FIG. 4.
Figure 8:
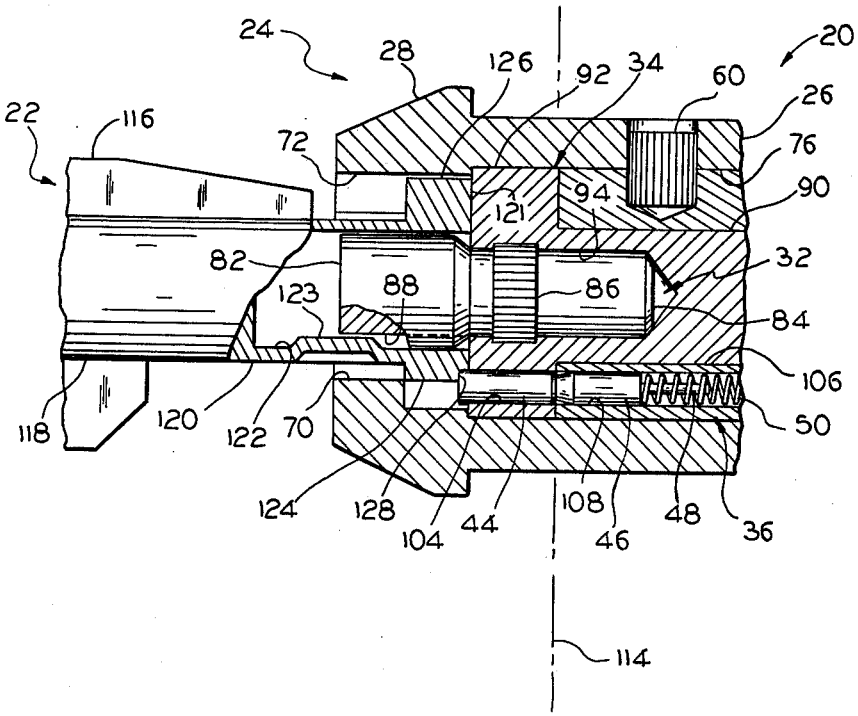
FIG. 8 is a fragmentary view similar to FIG. 7, but showing the lock mechanism with the key inserted therein to free a rotatable operating part of the lock mechanism for rotation.

Referring to FIGS. 6–8, in particular, the lock mechanism 20 includes a tubular lock cylinder 24 having an elongated tubular body 26 and an enlarged frusto-conical head 28 on the body at the front end 29 of the lock mechanism. A barrel assembly is secured within the cylinder 24, and it includes a rotatable operating part 30, which in the illustrative embodiment is constructed of separate parts, including a post unit 32 and a spindle unit 34. The barrel assembly also includes a stationary part 36 in the form of a cylindrical tubular sleeve member in which the operating part 30 rotates. The operating part 30 rotates about a longitudinal axis 37, which is common to the barrel assembly and its parts.

The lock mechanism 20 is operated by turning the operating part 30. In the illustrative embodiment, a stop disc 38 is received on the operatng part 30 and cooperates with the cylinder body 26 to limit rotation of the operating part, as described hereinafter. Referring to FIG. 7, a locking plate or arm 40, typical of "cam lock" mechanisms in general, may be mounted on the operating part 30 and secured thereon by a nut 42.

Split-pin tumblers are carried by the operating part 30 and the stationary part 36. The tumblers each include a generally cylindrical driver pin or element 44, carried by the operating part 30, and a generally cylindrical follower or locking pin or element 46 having a cylindrical body 47 and a reduced diameter cylindrical stem 48, carried by the stationary part 36. Coil compression tumbler springs 50 are carried by the stationary part 36 and received around the stems 48 of the follower pins 46. The lock tumblers, under the force of the tumbler springs 50, function to secure the operating part 30 against rotation relative to the stationary part 36, and are movable by the key 22 to free the operating part 30 for rotation relative to the stationary part 36.

The body 26 of the lock cylinder 24 bears a screw thread 54, and it is provided with a pair of diametrically opposed longitudinal flats or flat surfaces 56, which serve to prevent the lock mechanism from turning in its mounting. A pin-receiving hole 58 extends through the wall of the body 26, and it receives a drive-fit stationary part-mounting pin 60. An arcuate longitudinal extension 62 is integral with the rear end of the cylinder body 26, and the opposite edges 64 thereof constitute stop shoulders which cooperate with the stop disc 38.

The lock mechanism 20 is mounted in an opening in a wall, door or other member in a conventional manner, by inserting the cylinder body 26 through an opening therein, followed by clamping the member between the head 28 and a threaded nut (not shown) engaging the thread 54 on the body 26. The cylinder head 28 is left protruding, and it is accessible from the outside of the structure.

As seen in FIGS. 4, 5, 7 and 8, an annular closure flange 66 is integral with the cylinder head 28, and the flange extends radially inwardly from the head. The flange defines a central opening 68 into the lock cylinder 24, and eight angular apertures 70 extending radially outwardly from the opening 68 equiangularly at 45-degree angles therearound. The apertures 70 in the illustrative embodiment are right-angle openings which may be considered as formed by the intersection of two congruent squares concentric with the post unit 32 and rotated 45° relative to each other, thereby forming a "star-shaped" outline around the inside of the closure flange 66. A generally rectangular locating slot 72 extends radially outwardly from and as a continuation of one aperture 70*a*, the aperture and slot serving to locate the key 22 for insertion in the lock cylinder 24. The sides of adjacent apertures 70 intersect at angles of 135°, at eight points 74 constituting the innermost points of the closure flange 66. The flange opening 68 is the area within an imaginary circle through the points 74.

Referring to FIGS. 7 and 8, the interior of the lock cylinder 24 includes a cylindrical rearwardly disposed inner wall surface 76 on the body 26, and a circular forwardly disposed ring section 78 of reduced inside diameter with respect to the rear wall surface 76. The ring section 78 is integral with the closure flange 66 and with the adjoining portion of the cylinder head 28, and the ring section forms a spindle unit-spacing shoulder 80 at its junction with the rear wall surface 76.

Referring to FIGS. 6–8, the post unit 32 of the operating part 30 includes a generally cylindrical key guide post 82 and an integral coaxial generally cylindrical shank 84 of reduced diameter having a slightly enlarged knurl ring 86 therearound. A longitudinal blind drive groove 88 (see FIGS. 5 and 8), substantially rectangular in cross section, is provided in the post 82, extending between its front and rear ends.

The spindle unit 34 includes a generally cylindrical lock shaft 90 and an integral coaxial cylindrical head 92 of greater diameter. The diameter of the head 92 is approximately the same as but slightly smaller than the diameter of the rear inner wall surface 76 of the cylinder 24. A cylindrical blind bore 94 (FIGS. 7 and 8) extends from the front end of the head 92 into the shaft 90 coaxially therewith. The shank 84 of the post unit is driven into the bore 94 of the spindle unit, with the knurl ring 86 providing a tight drive fit and the post 82 coaxial with the shaft 90 and the head 92. The post and spindle units 32 and 34 thus are rigidly fixed relative to each other in the resulting operating part 30. Alternatively, the operating part 30 may be constructed in other ways, with any of the post, lock shaft, and head components separate or integral with some or all of the remaining parts, as most desirable for manufacturing and intended use. The rear end of the lock shaft 90 is provided with a screw thread 96 and with two diametrically opposed, longitudinally extending flats 98. The construction serves for mounting the stop disc 38 and the locking plate 40 fixedly on the lock shaft 90, where they are secured by the nut 42.

The head 92 has an annular front face 100 which surrounds the guide post 82 and an annular rear face 101 which surrounds the shaft 90. Each of the faces 100 and 101 lies in a plane perpendicular to the longitudinal axis 37 of the operating part 30. An annular series of longitudional cylindrical tumbler bores 104 is provided in the head 92, and they extend rearwardly from the front face 100 to the rear face 101 in parallel relation to the axis 37 and spaced radially outwardly from the post 82. There are seven such bores 104 in the illustrative embodiment, spaced at angles of 45° from each other, except for a 90° spacing between two of the bores. The bores 104 all have the same diameter and are disposed at equal radii from the axis 37.

The stationary part 36 has a longitudinal axial bore 106 of a diameter slightly greater than the diameter of the lock shaft 90. The outside diameter of the stationary part 36 is slightly smaller than the diameter of the rear inner wall surface 76 of the cylinder 24. The stationary part 36 is provided with an annular series of seven longitudinal cylindrical tumbler blind bores 108, which extend rearwardly from the front face 110 of the stationary part in parallel to its longitudinal axis. The bores 108 in the stationary part 36 have the same diameters and spacing as do the head bores 104, and the radial distances of the respective bores from the longitudinal axes of the respective parts are the same. Thus, the stationary part bores 108 are spaced at angles of 45° from each other around the longitudinal axis of the stationary part, except for a 90° spacing between two of the bores. A radial mounting pin-receiving bore 112 is provided in the stationary part 36, in the area between the tumbler bores 108 which are spaced apart 90°.

Referring to FIGS. 7 and 8, the lock mechanism 20 is assembled with the rotatable operating part 30 having its shaft 90 closely received within the stationary part bore 106, and with the spindle unit head 92 and the stationary part 36 received within the lock cylinder body 26 closely adjacent to its rear inner wall surface 76 therearound. The guide post 82 is enclosed by and spaced from the closure flange 66, and it extends approximately to the front end 29 of the lock mechanism. The front face 100 of the spindle unit head 92 is adjacent to the shoulder 80 in the cylinder 24. The front face 110 of the stationary part 36 adjoins the rear face 101 of the head 92 at a transverse interfacial plane 114. The mounting pin 60 is inserted with a force fit in the pin-receiving hole 58 in the cylinder body 26 and the registering pin-receiving bore 112 in the stationary part 36. The operating part 30 as thus mounted is rotatable about its longitudinal axis 37, which axis coincides with the longitudinal axes of the lock cylinder 24 and the stationary part 36.

Figure 5:
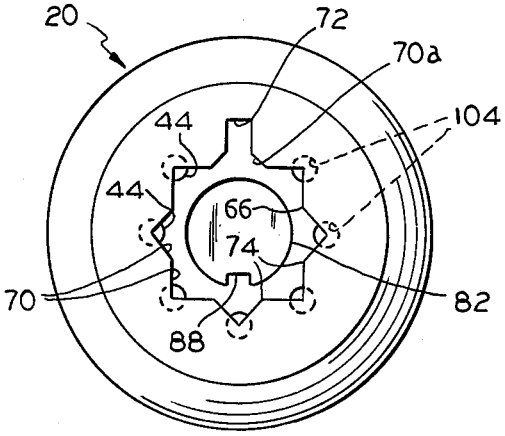
FIG. 5 is an enlarged end elevational view of the front end of the lock mechanism.

In the initial condition of the lock mechanism 20, illustrated in FIG. 7, the longitudinal tumbler bores 104 in the spindle unit head 92 are in longitudinal alignment with respective longitudinal tumbler bores 108 in the stationary part 36. The portion of the head 92 between the two bores 104 thereof angularly spaced at 90° is in longitudinal alignment with the corresponding portion of the stationary part 36, in which the mounting pin 60 is inserted. Such aligned head and stationary part portions also are in longitudinal alignment with the locating slot 72 and the aperture **70*a* in the closure flange 66, as illustrated in FIG. 5. The head tumbler bores 104 and their aligned stationary part tumbler bores 108 are aligned with respective apertures 70. As also seen in FIG. 5, the longitudinal axes of such tumbler bores substantially coincide with the outermost points of the angular apertures 70, and each of the apertures subtends approximately one quadrant of each bore, when viewed from the front. The tumbler bores 104 and 108 are disposed radially outwardly of the flange opening 68. As seen most clearly in FIG. 5, the drive groove 88 in the post 82 faces one of the tumbler bores 104 substantially in a longitudinal plane therewith. Such bore 104 in the illustrative embodiment is diametrically opposite to the locating slot 72**, at which no tumbler bore is present.

A tumbler spring 50 is seated in each of the blind bores 108 in the stationary part 36, and the stem 48 of one of the follower pins 46 is received in each spring, as illustrated in FIGS. 7 and 8. The driver pins 44 are received in the tumbler bores 104 in the spindle unit head 92. The tumbler pins 44 and 46 are of various lengths, to resist picking attempts. In the initial condition of the lock mechanism 20 illustrated in FIG. 7, wherein the tumbler bores 104 and 108 are in alignment, a complete tumbler is formed in each pair of aligned bores by a driver pin 44 and a rearwardly adjoining follower pin 46. A spring 50 yieldingly urges the pins 44 and 46 of each tumbler forwardly into positions wherein the interfacial plane 114 is bridged by the follower pin 46 of each tumbler, to secure the operating part 30 and the stationary part 36 against rotation relative to each other. At this time, the front ends of the driver pins 44 abut on the inner surface of the closure flange 66 therearound, with a quadrant portion of each driver pin accessible to the key 22 through an aperture 70, as illustrated in FIG. 5.

Figure 2:
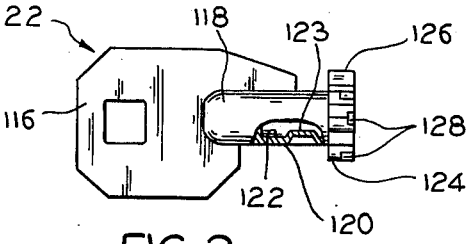
FIG. 2 is a side elevational and partly broken and sectional view of the key.
Figure 3:
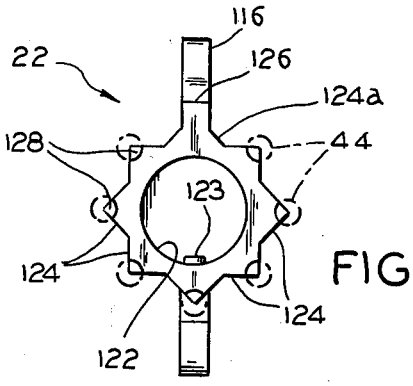
FIG. 3 is an enlarged end elevational view of the key, illustrating the manner in which it engages tumbler driver elements, shown in phantom lines.

Referring to FIGS. 1–3, the key 22 includes a wing-type torque-applying or manipulating handle 116, and a generally cylindrical body 118 secured to the handle. The body 118 includes a cylindrical tubular shank 120 at the outer end 121 of the key, and the shank defines a substantially cylindrical guide post-receiving socket 122. A drive lug 123 on the shank 120 extends radially inwardly from the wall of the socket 122, at a location spaced longitudinally inwardly from the outer end 121. The diameter of the socket 122 is such as to closely receive the guide post 82 therein, and the drive lug 123 has a radial depth substantially as great as the radial depth of the drive groove 88 in the post 82, as described hereinafter.

Eight tangs 124 extend radially outwardly from the outer periphery of the shank 120 at 45-degree angles therearound. The tangs are right-angle projections which may be considered as having the outline of two congruent concentric intersecting squares which are rotated 45° relative to each other. A generally rectangular guide lug 126 is integral with and forms a radial extension of one tang **124*a*. Otherwise, the tangs 124 extend radially outwardly for equal distances from the longitudinal axis of the shank 120. The outline of the tangs 124 and the guide lug 126, as seen from the outer end 121, is substantially congruent with the outline of the closure flange 66, for receiving the key end within the flange with slight clearance therebetween. The tangs 124 and the guide lug 126 extend on the shank 120 for equal distances longitudinally inwardly from the outer end 121** of the key.

Each of the tangs 124, except for the tang **124*a*, is cut away from the outer end 121 of the key, on the arc of a circle, to provide a bitting 128 constituting substantially the quadrant of a circle congruent with the front end of a driver pin 44 (shown in phantom lines in FIG. 3). The bittings 128 are formed in their tangs 124 for engagement with the front ends of the driver pins 44 at varying distances from the outer end 121 of the key, for cooperation with driver pins 44 of correspondingly varying lengths. The outer end surfaces of the shank 120, the tangs 124 (where not cut away) and the guide lug 126 lie in a plane at the outer end 121 perpendicular to the longitudinal axis of the shank 120**.

The key 22 is insertable in the lock cylinder 24 for the purpose of rotating the operating part 30 and thus the locking plate 40 between locking and unlocking rotational positions thereof. The key 22 is insertable by first aligning the guide lug 126 with the locating slot 72 in the closure flange 66, and aligning the socket 122 to receive the guide post 82, which result in alignment of the tangs 124 with the apertures 70 and the drive lug 123 with the drive groove 88. The shank 120 is insertable in the annular space between the post 82 and the points 74 of the closure flange 66.

As the key 22 is inserted, the tangs 124 and the guide lug 126 are received closely within and then pass through the closure flange 66, into the lock cylinder 24 and beyond the flange 66. The outer end 121 of the key bottoms on the face 100 of the spindle unit head 92. The bittings 128 engage the front ends of respective driver pins 44 as the key 22 is inserted. The driver pins 44 are moved rearwardly against the bias of the tumbler springs 50, to positions wherein the interfacial plane 114 coincides with the joints between the driver and follower pins 44 and 46, as illustrated in FIG. 8, to free the operating part 30 for rotation. At this time, the drive lug 123 is received in the drive groove 88 to engage the key 22 with the post 82, and thereby with the operating part 30, for rotating the operating part by turning the key.

The lock mechanism 20 in the illustrative embodiment is adapted for 90-degree rotation of the operating part 30 between locking and unlocking positions. For this purpose, the stop disc 38, which is rotatable with the shaft 90, is provided with a projection 130 (FIGS. 6 and 7) which engages the stop shoulders 64 on the lock cylinder extension 62 alternately upon 90-degree rotation in opposite directions. The locking plate 40, also rotatable with the shaft 90, rotates 90°, according to the limits established by the stop disc 38 and the extension 62, between a locking position wherein the plate 40 engages a suitable keeper, latching member, or the like, and an unlocking position of disengagement therefrom. In the illustrative embodiment, the operating part 30 is rotated in the clockwise direction from its initial, locking position to its unlocking position. If desired, the extent of rotation may be varied and/or the directions of rotation between positions may be reversed, by suitable adjustment of the stop means provided by the lock cylinder extension 62 and the disc projection 130. Alternatively, where turning beyond 360° is acceptable, the stop means may be eliminated.

The key guide lug 126 and the tangs 124 extend longitudinally on the shank 120 from the outer end 121 of the key for distances equal to the length or depth of the internal ring section 78, as measured between the flange 66 and the shoulder 80 in the lock cylinder 24. Consequently, the inner edges of the guide lug 126 and of the tangs 124, which are adjacent to the handle 116, substantially abut on the inner surface of the flange 66 as the key 22 is turned, to hold the driver pins 44 with their inner ends at the interfacial plane 114 and maintain the key in the lock cylinder 24 during turning.

The key 22 can be inserted and removed from the lock cylinder in one position only, that is, in the position in which the guide lug 126 registers with the locating slot 72, providing what is known as a "one-way key pull". The lock mechanism 20 then is in its initial, locked condition. Alternatively, a "two-way key pull" may be provided, for example, by forming a second locating slot like the slot 72 at an aperture 70 angularly spaced 90° from the aperture **70*a*. With a two-way key pull, the key also can be removed and reinserted when the lock mechanism 20 is in its unlocking condition, while certain of the follower pins 46 bridge the interfacial plane 114** with the key removed.

An important feature of the invention resides in the disposition of the drive groove 88 in the guide post 82, with respect to the tumbler bores 104 in the spindle unit head 92. As described above and illustrated in FIGS. 5 and 8, the drive groove 88 faces one of the tumbler bores 104 substantially in a longitudinal plane therewith. This disposition of the drive groove 88 is to be contrasted with the disposition of similar drive grooves in prior lock mechanisms, as represented by the structures of the above-referred to U.S. Pat. Nos. 3,102,412 and 3,916,657. In such structures, the drive grooves conventionally face an area of a spindle unit head or the like having no tumbler bore therein, which area is aligned with a rearwardly disposed sleeve area into which a mounting pin extends, in the manner of the mounting pin 60 herein.

The present invention makes it difficult and/or expensive to provide a lock pick of the popular type illustrated in U.S. Pat. No. 3,270,538. Thus, such a pick must be provided with an internal lug, similar to the drive lug 123 herein, which is received in the drive groove 88 in the post 82, to provide a means of applying torque to the post while the tumblers are probed. Such a lug commonly is provided on a pick by punching or stamping a small portion of the tubular body of the pick inwardly. In order to provide such a lug on a pick for the present lock mechanism, however, it would be necessary to punch the tubular body at the same place that a groove in the surface thereof is required for carrying a finger or probe (identified as number 58 in said U.S. Pat. No. 3,270,538). This is because the drive groove 88 herein faces a bore 104 carrying the driver pin 44 of a tumbler. When a lug is punched in the pick body in such a location, from which metal already has been removed to provide a picking finger groove, however, the support for the lug is inadequate, and the lug breaks off when it is attempted to apply torque to the post of the lock mechanism. Other possible ways of providing a lug in the necessary location are complicated by requirements for exact placement and close tolerances, freedom from interference by welding or brazing flux, and special manufacturing equipment.

An additional improvement is provided by forming the drive groove 88 in the guide post 82 with a depth, as measured in the radial direction, which is a maximum of about 0.030 inch. The sides of the groove 88 then will function to engage the drive lug 123 in turning the operating part 30 with the key 22, but, as a result of their relative shallowness, the lug of a picking tool will have a tendency to slip out of the groove when it is attempted to apply torque to the post during a picking attempt. The depth dimension is particularly applicable to lock mechanisms of the common commerical sizes, having $\frac{3}{4}$ inch and $\frac{7}{8}$ inch outside diameter cylinder bodies 26. This improvement is useful both together with the foregoing improvement in disposition of the drive groove, and independently thereof. In comparison, the depth of the drive groove in the post of a comparable standard commercial lock is a minimum of about 0.046 inch.

A further feature which cooperates to increase the difficulty and expense of designing and making a pick or a key is the construction of the closure flange 66. As noted above, the tumbler bores 104 in the spindle unit head 92, and likewise the aligned tumbler bores 108 in the stationary part 36, are disposed radially outwardly of the opening 68 defined by the flange, such opening being circumscribed by an imaginary circle through the points 74. With this structure, the tumbler bores 104 and the tumblers therein rotate to positions entirely beneath and covered by the flange 66, as the operating part 30 is rotated out of its initial position. Consequently, the fingers of a pick like that illustrated in the aforementioned U.S. Pat. No. 3,270,538 cannot travel with the tumblers to the unlocking disposition of the operating part, rotated 90° from the initial position. This feature per se is known from the prior art, such as U.S. Pat. No. 3,813,906, and also is disclosed in my copending application Ser. No. 716,157, filed Aug. 20, 1976, now U.S. Pat. No. 4,069,696.

An important advantage of the invention is that the lock mechanism 20 may be manufactured from standard unfinished and finished parts and/or with standard machinery. Thus, the lock cylinder 24 may be manufactured from a standard unfinished part, altering the operations to provide the unique closure flange 66. The post unit 32 may be formed from rod stock in the same machinery as corresponding standard parts, with reduction in the diameter of the post 82 and in the depth of the drive groove 88. The remaining parts of the lock mechanism 20 are standard.

The key 22 is uniquely constructed for cooperation with the lock mechanisms 20. Thus, the drive lug 123 on the key shank 120 extends radially inwardly from the wall of the socket 122 and substantially in a longitudinal plane with one of the bittings 128 and adjacent thereto. The adjacent bitting 128 is adapted to engage the tumbler driver pin 44 carried by the tumbler bore 104 adjacent to the drive groove 88, which faces the tumbler bore as described above. In this connection, the corresponding drive lugs of conventional keys are adjacent to and in longitudinal planes with guide lugs such as the lug 126 herein, for interengaging drive grooves similar to the groove 88 herein and which face locating slots such as the slot 72 herein and blank areas of spindle unit heads such as the head 92 herein.

The key 22 is not easily duplicated, and, in particular, it cannot be made readily from a plain tube. Either special tooling or considerable effort is required to make such a key, having a circular-type shank, tangs extending radially therefrom, and bitting cuts in the tangs extending longitudinally in the direction of the axis of the shank.

While a preferred embodiment of the invention has been illustrated and described, and reference has been made to certain changes which may be made in the embodiment, it will be apparent that further changes and modifications may be made therein within the spirit and scope of the invention. It is intended that all such changes and modifications be included within the scope of the appended claims.

Having thus described the invention, what I claim as new and desire to secure by Letters Patent is:

1. In a combination of an axial split-pin tumbler-type lock mechanism and a key therefor, said mechanism including a lock cylinder, and an operating part disposed forwardly within said cylinder and rotatable about a longitudinal axis extending between front and rear ends of the part, said cylinder including an annular flange on a front end thereof which extends radially inwardly and defines a central opening into the cylinder and a plurality of apertures extending radially outwardly from the opening therearound, said operating part including a cylindrical head and a key guide post having a reduced diameter with respect to the head and extending axially forwardly therefrom into said opening and spaced from said flange, said head having longitudinal tumbler bores extending therethrough and disposed radially outwardly of said opening, portions of said bores being aligned respectively with said apertures in an initial condition of the lock mechanism;

said key including a shank having a socket adapted for receiving said post therein and the shank also being insertable in the space between said flange and said post, and bittings on the outer periphery of said shank adapted for endwise engagement with tumblers carried by said bores to free the operating part for rotation;

the improvement which comprises means providing a longitudinal blind drive groove in said post and facing one of said tumbler bores substantially in a longitudinal plane therewith, said groove having a maximum depth of 0.030 inch, a drive lug on said shank extending radially inwardly from the wall of said socket and substantially in a longitudinal plane with one of said bittings and adjacent thereto, said lug being adapted to be received in said groove for interengaging the key and the operating part to cause the latter to rotate when the key is turned, said one bitting being adapted to engage a tumbler carried by said one bore, said groove depth being such that upon inserting the lug of a picking tool in the groove and attempting to apply lock-picking torque to said post by engagement with the lug during operation of the tool, the tool will tend to slip owing to a tendency of its lug to slip out of the groove, and a plurality of tangs extending radially outwardly from the outer periphery of said shank, said tangs being equal in number to the number of said bittings and each being provided with one of said bittings, said tangs being insertable respectively through said apertures and internally of said cylinder beyond said flange in engagement with said tumblers when said bore portions are in said alignment, and the inserted tangs turning behind said flange as the key is turned.

* * * * *